United States Patent [19]

Patterson et al.

[11] Patent Number: 4,732,786

[45] Date of Patent: Mar. 22, 1988

[54] INK JET PRINTABLE COATINGS

[75] Inventors: Robert Patterson; David H. Hollenberg, both of Neenah, Wis.; Robert C. Desjarlais, South Hadley, Mass.; George E. Alderfer, Neenah, Wis.

[73] Assignee: James River Corporation, Richmond, Va.

[21] Appl. No.: 809,870

[22] Filed: Dec. 17, 1985

[51] Int. Cl.[4] ..... B41M 5/00

[52] U.S. Cl. ..... 427/261; 346/1.1; 346/135.1; 427/288; 427/421; 428/195; 428/207; 428/211; 428/341; 428/342; 428/513; 428/532; 428/535; 428/704

[58] Field of Search ..... 346/1.1, 135.1; 427/261, 288, 421; 428/195, 207, 211, 411.1, 913, 914, 341, 342, 513, 532, 535, 537.5, 704

[56] References Cited

U.S. PATENT DOCUMENTS

| | | | |
|---|---|---|---|
| 3,878,038 | 4/1975 | Opderbeck et al. . | |
| 3,912,532 | 10/1975 | Simone . | |
| 4,090,013 | 5/1978 | Ganslaw et al. . | |
| 4,111,922 | 9/1975 | Beede et al. . | |
| 4,172,177 | 10/1979 | Sato . | |
| 4,248,685 | 2/1981 | Beede et al. . | |
| 4,269,891 | 5/1981 | Minagawa . | |
| 4,308,542 | 12/1981 | Maekawa et al. . | |
| 4,335,184 | 6/1982 | Miyamoto et al. . | |
| 4,371,582 | 2/1983 | Sugiyama et al. . | |
| 4,399,193 | 8/1983 | Preiner et al. . | |
| 4,405,744 | 9/1983 | Greinecker et al. . | |
| 4,419,388 | 12/1983 | Sugiyama et al. . | |
| 4,425,405 | 1/1984 | Murakami et al. . | |
| 4,442,172 | 4/1984 | Oshima et al. . | |
| 4,446,174 | 5/1984 | Maekawa | 346/135.1 |
| 4,474,847 | 10/1984 | Schroder et al. . | |
| 4,474,850 | 10/1984 | Burwasser | 346/135.1 |
| 4,478,910 | 10/1984 | Oshima et al. . | |
| 4,481,244 | 11/1984 | Haruta et al. . | |
| 4,503,111 | 3/1985 | Jaeger et al. . | |
| 4,503,118 | 3/1985 | Murakami et al. . | |
| 4,517,244 | 5/1985 | Kobayashi et al. . | |
| 4,528,242 | 7/1985 | Burwasser | 346/135.1 |
| 4,564,560 | 1/1986 | Tani et al. | 346/135.1 |

*Primary Examiner*—Bruce H. Hess
*Attorney, Agent, or Firm*—Finnegan, Henderson, Farabow, Garrett & Dunner

[57] ABSTRACT

A coated ink jet printing substrate where said coating utilizes an insolubilized hydrophilic polymer.

12 Claims, No Drawings

INK JET PRINTABLE COATINGS

This invention relates to coatings. It further relates to coatings useable in ink jet printing processes. More specifically it relates to coating formulations that can be used on several different products to make those products suitable for ink jet printing.

Coatings for ink jet printing must provide a surface that is receptive to the inks used in the process. In the past this has been achieved through the use of high pigment to binder ratios, usually in combination with pigments or coating materials that provide very porous and permeable coating layers. Because of the highly specific requirements for ink jet printing, coated materials used in other printing processes generally cannot be used for ink jet printing.

There are two primary requirements for ink jet printing. The first is that the coating, the substrate, or the combination of the two, must be absorbent enough to immobilize the vehicle of the inks away so that the inks will not smear. The second requirement is that the coating provide a means of keeping the dyes in the ink on the surface. If the dyes are not kept on the surface, the color could fade because the dyes would be diluted by the high light scattering ability of the pigments used in the coating.

The hydrophilic polymer containing compositions of the instant invention fulfill both of these requirements to a desirable degree. They are capable of absorbing the vehicle of the ink to keep it from being available to the ink before the ink dries and they have the ability of holding the dyes of the aqueous inks on the surface.

It has also been found that the incorporation of a small amount of insolubilized hydrophilic polymers into coating formulations provides ink jet receptive coatings that are not dependent upon the use of high pigment to binder ratios. These polymers, when insolubilized in situ, can act as binders for pigments thereby reducing or eliminating the use of traditional coating binders.

The absorption ability of these polymers has also reduced the need for a very porous and permeable coating layer. The insolubilized polymers can absorb many times their weight of water.

These advantages allow substrates coated with hydrophilic polymers to be used in a number of different printing processes, as well as ink jet printing. Prior formulations for ink jet printing fell short on surface strength and therefore were limited to noncontact or nonimpact printing processes. With the use of hydrophilic polymers, higher effective binding capacity can be achieved and therefore stronger surfaces can be made which will be able to withstand the problems associated with printing processes, such as offset printing, which produce tremendously high tack on the surface.

SUMMARY OF THE INVENTION

This invention provides an ink jet printing coating formulation that does not require a high pigment to binder ratio. Further, the invention provides a coating that does not require that pigments and coating materials be selected to provide very porous and permeable coating layers. The invention also provides a means for adapting a variety of substrates so that they can be used in ink jet printing as well as other types of printing processes.

The present invention then, is a coated substrate for ink jet printing comprising the substrate having a continuous coating on at least one surface thereof comprising from 0 to 90 parts by weight of pigment; from 0 to 95 parts by weight of binder; and from about 1 to 100 parts by weight of an insolubilized hydrophilic polymer. In a preferred embodiment, the present invention is a coated paper suitable for ink jet printing comprising a layer of paper having a continuous coating on at least one surface thereof comprising from 0 to 90 parts by weight pigment; from 0 to 95 parts by weight binder; and from about 1 to 100 parts by weight of an insolubilized hydrophilic polymer. In another preferred embodiment, the present invention is a coated film for ink jet printing comprising a film having a continuous coating on at least one surface thereof comprising from 0 to 90 parts by weight of pigment; from 0 to 95 parts by weight of binder; and from about 1 to 100 parts by weight of an insolubilized hydrophilic polymer.

The invention also includes a coating composition used for ink jet printing comprising from 0 to 90 parts by weight pigment; from 0 to 95 parts by weight a binder; from about 1 to 100 parts by weight a hydrophilic polymer and from 0.1 to 50 milliequivalents polyvalent cation per gram of polymer; the polyvalent cation having a valence greater than one and a coordination number greater than two.

This invention further includes the process for making an ink jet printable substrate comprising coating the substrate with about 2 to about 30 grams per square meter of a coating composition comprising from 0 to 90 parts by weight of pigment; from 0 to 95 parts by weight of binder; from about 1 to 100 parts by weight a hydrophilic polymer; and insolubilizing said hydrophilic polymer on the substrate. In a preferred embodiment, the process comprises coating merchant paper grades #1 through #5, or bond paper grades #1 and #2 with about 2 to about 30 grams per square meter of a coating comprising from 0 to 90 parts by weight pigment; from about 0 to 95 parts by weight of binder; from about 1 to 100 parts by weight of a hydrophilic polymer and insolubilizing the hydrophilic polymer on the paper. In another preferred embodiment, ink jet printable film is made by the steps comprising coating a film with about 2 to about 30 grams per square meter of a coating, to provide a coating from about 0.1 to about 0.5 mils thick on the film, the coating comprising from 0 to 90 parts by weight of pigment; from 0 to 95 parts by weight of binder, and from about 1 to 100 parts by weight a hydrophilic polymer; and insolubilizing the hydrophilic polymer on the film.

The invention in these embodiments preferably includes from 0.1 to 50 milliequivalents polyvalent cation per gram of polymer, the polyvalent cation having a valence greater than one and and a coordination number greater than two. Preferably, the polymer is insolubilized in the presence of this cation by lowering the pH of the coating composition.

Although paper and film are the preferred substrates, any substrate can be used within the scope of the invention. Examples of substrates suitable to this invention include paper, coated paper, paper laminants and films.

DETAILED DESCRIPTION OF THE INVENTION

According to the instant invention, a hydrophilic polymer is incorporated into coating formulations. The polymer is insolubilized in situ through the use of a polyvalent metal cation, or by other means, such as covalent cross-linking or electron beam curing.

The components of the preferred invention comprise the polymer and a polyvalent metal cation. The components can either be pre-mixed and then added to the coating formulation or can be added separately to the coating preparation. This addition can be done at anytime during the processing of the coating preparation. The incorporation of the hydrophilic polymer does not preclude the use of any coating process or processes.

The hydrophilic polymer and the polyvalent metal cation form in the coating an ionic complex. This complex, as known in the art, is a water insoluble absorbent. U.S. Pat. No. 4,090,013, hereby incorporated by reference, discloses these compositons. By controlling the pH, these compounds can be complexed or uncomplexed; known in the art as the pH of reversibility.

Critical to the performance of these polymers is this ability to control complexation. This means the polymer and the cation can be added to the coating without adversely affecting the coating's viscosity. Once the coating is applied to the substrate, the complex can be formed and thereby, the polymer insolubilized.

Any method can be use to control the pH and thereby control the complex. Preferably, a volatile base, such as ammonia, will be added to the coating formula during processing to keep the polymers in an uncomplexed state. Once the coating is applied, the base is volatilized, thereby reducing the pH and complexing the polymer. The polymer can also be complexed by the addition of an acid.

During the incorporation of the polymers into the coating formula, the pH is maintained at a level such that the polymers will not complex with the cation. This pH can vary from polymer to polymer but the pH generally ranges from about 5 to about 8.5. Preferably the coating composition is around a pH of about 8.5. During the drying stage of the coating the pH of the coating is reduced to a pH ranging from about 8 to about 4. At that pH the cation complexes with polymer thereby creating an insolubilized polymer in the coating.

In another embodiment, the polymers are complexed using organic cross-linking agents. In this embodiment, the polymers are covalently cross-linked by heating the coating after it is applied to the substrate.

The polymer can also be complexed utilizing electron beam cross-linking. When utilizing 'E.B.' cross-linking, the amount of energy necessary to complex the polymer is that energy necessary to create radicals in the polymer being used. Generally, this will range from about 2 megarads to about 8 megarads, depending on the polymer type. Higher doses can be used but are not necessary to achieve the desired complexing.

The hydrophilic polymers suitable to this invention can be generally described as polymers having carboxylate, sulfonate and phosphate active groups. Specific hydrophilic polymers include polysaccharides, homopolymers of acrylic or methacrylic acid and copolymers of acrylic or methacrylic acid with one or more ethylenically unsaturated comonomers and salts thereof, hydrolyzed and partially hydrolyzed polyacrylamides and salts thereof; carboxylated polymers derived from homopolymerization of acrylonitrile or acrylamide and carboxylated polymers derived from copolymerization of acrylonitrile or acrylamide with one or more ethylenically unsaturated comonomers and salts thereof; homopolymers of hydroxyethyl methylacrylate, hydroxypropyl methylacrylate and copolymers of hydroxyethyl methacrylate, hydroxypropyl methacrylate and salts thereof; and carboxylated or partially carboxylated polymers derived from copolymerization of maleic anhydride with one or more ethylenically unsaturated comonomers, and esters, partial esters and salts thereof.

Suitable polysaccharides can be chosen from carboxyalkylcellulose, carboxyalkyl guar, carboxyalkyl-hydroxyalkyl guar, carboxyalkyl-hydroxyalkyl cellulose wherein said alkyl groups are methyl, ethyl or propyl radicals; karaya gum, xanthan gum, tragacanth gum, gum ghatti, carrageenin, psyllium, gum acacia, oxidized starches, oxidized cellulose, arabinogalactan, hemicelluloses and ammonium or alkali metal salts thereof.

Other suitable polymers, in addition to those previously described, include homopolymers of monoethylenically unsaturated sulfonic acids and copolymers of these with other ethylenically unsaturated monomers. Sulfonated monomers include: styrene sulfonic acid, 2-vinyl-3-bromobenzenesulfonic acid, and other alkyl and aryl substituted ethylenically unsaturated aromatic sulfonates, ethylene sulfonic acid, 2-acrylamido-2-methyl propanesulfonic acid and other aliphatic ethylenically unsaturated sulfonate monomers. Sulfonated derivatives of natural polymers such as cellulose, starch, water soluble polysaccharides and water soluble proteinaceous polymers can also be used.

Phosphate containing polymers could be derived from polymerization of phoshate containing ethylenically unsaturated monomers either through homopolymerization or copolymerization with other ethylenically unsaturated monomers. Water soluble phosphate derivatives of natural polymers, such as cellulose, starch, and other polysaccharides can also be used.

The preferred polymers are polyacrylic acid, polyacrylamide, and mixtures thereof.

Any polyvalent metal cationic compound can be used in the instant invention. Complexing can be achieved by the use of polyvalent cations in the form of metallic salts, complexes or partially alkylated metal compounds characterized by having a polyvalent cation with a valence greater than one and a coordination number greater than two. Illustrative cations include those of zirconium, titanium, hafnium, aluminum, iron, cobalt, zinc, tin and chromium.

Compounds that can be used to cross-link the polymers also include organic compounds such as epoxides, imines, epihalohydrins, polyhaloalkanols, amine-epihalohydrin adducts, and any other carboxylate, sulfonate or phosphate reactive compounds.

The coating formulations typically include pigment and binder. Emphasis in the prior art dictates the use of nonflake-like pigments for the use of ink jet printing. Flakey pigments include clays, talcs, micas. Nonflake-like pigments include calcium carbonate, silicas, aluminum trihydrate, calcined clays and all other types of pigments known in the art. The percentage of nonflake-like pigment used in the instant invention can range anywhere from about 5% to about 100% of the pigment. With this pigment combination, there is sufficient openness to the sheet to allow the vehicle in the ink to penetrate the sheet and then the polymer can absorb the moisture of the ink rapidly and keep it immobilized.

The binder can consist of a hydrophilic binder or a combination of hydrophilic and hydrophobic binders which will allow the coating surface to remain open and receptive to aqueous vehicles in the ink jet ink. Typical materials suitable for binders include styrene butadene latex, polyvinylacetate latex, starches, polyvinyl alcohol, proteins, such as soy protein, casein and animal glue, cellulose derivatives, and acrylic emulsions.

Generally, the formula for a coating depends upon the type of device used for applying the coating and the type of substrate on which the coating is applied. Three main devices used for applying a coating are a size press device, a blade device, and a wire wrapped rod device.

The size press is typically an on-machine device for applying a chemical to the surface of substrate. It is located just after the main dryers. The size press is a set of two rolls forming a nip through which the substrate passes. A liquid formulation can be added to the nip on either or both sides of the substrate on the inlet side of the nip. The liquid is metered by the pressure in the nip. The substrate then passes on to the drying section of the machine.

The blade coating is typically, but not always, an off-machine coating apparatus. In this process, a coating formulation is applied to the surface of the substrate and then metered off by a blade dragging across the surface of the substrate.

A wire wrapped rod device is often a bench scale device, but can also be used with films and other substrates. In this device, the substrate is coated and the excess coating is metered off by dragging the substrate across the wire wrapped rod. A Meyer rod is a typical example of this device.

The differences between these processes are many. These include process speed, coating viscosity, coating solids, types of materials that can be applied, depth of penetration of the material into the substrate, surface characteristics of the substrate coming out of the process and the ultimate quality of the substrate produced.

The size press, because it is typically an on-machine device, is limited by the speed of the machine. The viscosity of the coating material is typically lower than in blade coaters. Because of the nature of the metering done, the viscosity must be low enough to be metered by the nip. The low viscosity dictates that the solids content must remain lower than compositions for blade coating. Due to the hydraulic pressures in the nip, the coating will penetrate the sheet more and result in less material sitting up on the top of the sheet. The size press is good for producing bond-like papers with bond-like surface characteristics for monochrome printing.

The blade coating technique, on the other hand, is conductive to high speeds, relatively high viscosities and produces merchant printing paper grades. The coating sits up on the surface of the paper more than it does in the size press operation and therefore is available for generating very smooth surface characterisitics. This type of merchant printing paper is a much higher quality sheet than the bond sheet made on the size press.

The three coating process described above are preferred but there are other coating processes that can be used. Using the coating formula of the instant invention, high quality 4-color ink jet printing can be done on substrates coated with any coating process.

In the prior art the formulations for ink jet printing coating consisted of a high pigment to binder ratio. In U.S. Pat. No. 4,474,847 for instance, a ratio of about 9:1 is the smallest pigment to binder ratio disclosed when the substrate is paper. Generally in the instant invention, the pigment to binder ratio ranges from 9:1 to 1:20, depending upon the process used in applying the coating. This can go as high as 100% binder with no pigment in certain applications of the size press process. For blade application the ratio of pigment to binder will typically be from 9:1 to about 4:1.

The amount of polymer present in the composition can also vary depending upon the method of application of the coating. Generally with 'size press' applications, the amount of polymer in the coating ranges from about 1 part based on 100 parts by weight pigment to the entire coating being polymer. On the other hand, when blade application is used, the amount of polymer can range from about 1 to about 20 parts, per 100 parts by weight pigment.

The polyvalent cation will be used in amounts sufficient to impart absorbent qualities to the polymer. In general this means the cation will be present in an amount ranging from about 0.1 milliequivalents to about 50 milliequivalents agent per gram of polymer.

The substrates suitable to this invention include any material which may be printed upon using an ink jet printing process. Typical examples of substrates include papers, films cloth, laminated composites and the like.

Any paper can be used in this invention. Preferred papers include merchant paper grades #1 through #5, and bond paper grades #1 and #2.

Any film can also be used in this invention. Preferred films include polyester based films, polystyrenes, polycarbonates, polysulfones, cellulose acetates, cellulose triacetates, ethyl cellulose, polyethylene, polypropylene, and the like. The film can be clear or opaque. The film can also incorporate any other suitable materials, such as silicas, pigments, air bubbles and the like.

The coating of the present invention is present on the substrate, on a solids basis, in an amount ranging from about 2 to about 30 grams per square meter. Generally with the size press applications the coating weight range is from about 2 to about 9 $g/m^2$. Preferably in our process, this will be from 5 to 9 $g/m^2$. On the other hand, when blade application is used, the amount of coating can range from about 6 to about 30 $g/m^2$ and preferably from 8 to 15 $g/m^2$.

When films are coated with the ink jet printing composition, the amount of coating applied is normally measured by the thickness of the resulting coating. Typically the coating will range from about 0.1 to about 0.5 mils in thickness. Preferrably, the coating will be about 0.25 mils in thickness.

Coating formula can be made in a variety of ways. A typical coating is made in the following manner. The most difficult pigment for makedown (shearing) is added to water in which the dispersant has been mixed. The combination of dispersant, water and pigment is agitated at extremely high speeds to develop the shear to break the pigments into their smallest component parts. The next pigment is added to this mixture with the water and dispersant necessary for its dispersion. And so on through the list of pigments which are necessary for the coating formulation.

The binder is prepared by cooking, if necessary, and cooling the binder to a temperature that will not shock the pigment. The binders are then added to the coating formulation with any other additives that are typically used for rheology modification, flow characteristics, stability or functional properties; in this case the hydrophilic polymer with the cross-linker. This method is a very generalized method and is modified liberally depending on the coating formulation to be used. Typical modifications of the above procedure are: (1) using binder in the makedown of the pigment to enable higher solids coatings to be made, or (2) the binders being added to the pigment slurry in a defined manner such that the possibility of pigment shock is minimized.

EXAMPLE I

The following is a typical formulation used for the preparation of the coating of the instant invention.

Pigment:
- 60 parts by weight Ultrawhite 90
- 40 parts by weight Albaglos

Binder:
- 8 parts by weight Dow 620 based on 100 parts pigment
- 2 parts by weight Vinac 881 based on 100 parts pigment
- 3 parts by weight Penford Gum 280 based on 100 parts pigment Other:
- 0.1 part by weight Colloid 211 based on the clay
- 0.1 part by weight Colloid 211 based on carbonate
- $NH_4OH$ to a pH of 8.5

Polymer:
- 1.8 parts by weight polyacrylic acid based on 100 parts by weight of the pigment Cross-Linking Agent:
- 5% of ammonium zirconium carbonate based on weight of hydrophilic polymer Ultrawhite 90 is a #1 coating clay sold by Englehardt Minerals and Chemicals. Albaglos is a precipitated calcium carbonate sold by Pfizer, Inc.

Dow 620 is a styrene butadiene latex sold by Dow Chemical. Vinac 881 is a polyvinylacetate latex sold by Air Products. Penford gum is an ethylated starch sold by Pennick and Ford Company. Colloids 211 is a dispersant used to disperse the two pigments sold by Colloids, Inc.

THEORETICAL EXAMPLE II

The following process steps can be used for making a coating with absorbent material.

| Coating Material | Dry Weight | Weight of Water Added | Wet Weight in Final Coating |
|---|---|---|---|
| Ultrawhite 90 | 1100 | 570 | 1570 |
| Albaglos | 700 | 300 | 1000 |
| Dow 620 | 144 | | 288 |
| Vinac 881 | 36 | | 72 |
| Penford Gum 280 | 54 | 216 + 180 | 450 |
| Colloids 211 on Clay | 1.8 | | 4.1 |
| Colloids 211 on Albaglos | 1.8 | | 4.1 |
| Hydrophilic Polymer | 30.8 | | 246 |
| Ammonium Hydroxide to pH | 5.5 | | |
| Ammonium Carbonate to pH | 8.0 | | |
| Ammonium Zirconum Carbonate | 1.54 | | 7.7 |

The makedown of the pigment proceeds as follows. In a high shear mix, 300 lbs. of water are added to the mixer. To this are added 4.1 lbs. of Colloids 211 as received. This blend is agitated and slowly the 700 lbs. of Albaglos are added. This mixture is allowed to shear in the high shear mixer mode for 30 minutes. This slurry is then pumped to the coating blend tank. In the same high shear mixer, 570 lbs. of water are added with the 4.1 lbs. of Colloids 211. To this are added the 1100 lbs. of Ultrawhite 90 clay. This also is sheared for 30 minutes, then added to the coating blend tank. Concurrent to the pigment makedown, 54 lbs. of Penford gum is added to 216 lbs. of water in the starch cooker. This mixture is heated to 195° F. and held there for 30 minutes. During the cooking process, the mixture is agitated continuously. When the starch is completely cooked, 180 lbs. of water are added to cool the starch down under agitation. The starch is then added to the coating blend tank along with the 288 lbs. of Dow 620 latex and 72 lbs. of Vinac 881 latex. $NH_4OH$ is used to bring the pH to 8.5.

In a separate tank, 246 lbs. of the hydrophilic polymer are mixed with enough ammonium hydroxide to raise the pH to 5.5. Then ammonium carbonate is added to raise the pH to 8.0. To this blend, 7.7 lbs. of ammonium zirconium carbonate are added. This blend is then added to the coating blend tank. The coating is allowed to agitate for 15 minutes and then is ready for application to the paper.

EXAMPLE III 50 grams of Rohm and Haas 25% polyacrylic solution (Acrysol A-5) was stirred in an open 250 ml. breaker. While stirring the contents, the pH was adjusted from a pH of 2.6 to a pH of 5.5 with dilute ammonium hydroxide solution.

The solution was then adjusted to a pH of 7.5 with solid ammonium carbonate by slow addition to prevent excess foaming. After the foaming had subsided there was added 1.25 grams of "Bacote 20" (a tartaric acid stabilized solution of ammonium zirconium carbonate). The Bacote 20 is supplied by Magnesium Elektron Inc.

The clear viscous solution was then coated with a #26 wire wound coating rod onto a polyester base film containing a suitable bonding layer. After drying the coated film for 5 minutes at 220° F. in a convection oven, a clear transparent coating was obtained of about 0.25 mils thickness.

The film received the aqueous inks from a Hewlett-Packard HP 2225B "Think-Jet" printer and dried in a reasonable amount of time. The film was free of tackiness by handling. By a judicious reduction in the amount of ammonium zirconium carbonate used to about 0.125 grams, a lesser degree of cure may be obtained. The objective being to bring the coating just to the point of being very slightly tacky and taking advantage of the higher degree of ink receptivity and dry time of the inks from ink-jet printers.

Other film substrates which may be coated in this manner are polystyrene, polycarbonate, polysulfone, cellulose acetate, cellulose triacetate, ethyl cellulose, polyethylene, polypropylene, and the like.

A small amount of silica may be added (about 0.05 to 0.20% by weight based on polymer) to the coating solution to prevent film-to-film blocking under storage conditions at elevated temperatures.

The silica size may be in the range of 2–5 microns. A typical silica is Syloid 308 made by W. R. Grace Co.

The above description and examples are intended to be exemplary of embodiments of the invention and variations and modifications of the invention can be made within the scope of the appended claims.

What is claimed is:

1. A method for ink jet printing comprising using in said ink jet printing a coated substrate, a layer of said substrate having a continuous coating on at least one surface thereof comprising:

(a) from 0 to 90 parts by weight of pigment;

(b) from 0 to 95 parts by weight of binder;

(c) from about 1 to 100 parts by weight of an insolubilized hydrophilic polymer; and (d) from about 0.1 to about 50 milliequivalents per gram of polymer of a polyvalent cation selected from metallic salts, complexes and partially alkylated metal compounds having a valence greater than one and a coordination number greater than two.

2. The method of claim 1 in which the coating is present in an amount ranging from about 2 to about 30 grams per square meter.

3. The method of claim 1 where said hydrophilic polymer is selected from polyacrylic acid and polyacrylamide.

4. The method of claim 1 where said polymer has at least one of a carboxylate, sulfonate and phosphate active group.

5. The method of claim 1 where said polymer is selected from the group consisting of polysaccharides, homopolymers of acrylic and methacrylic acid, copolymers of acrylic and methacrylic acid with one or more ethyleneically unsaturated comonomers and salts thereof, hydrolyzed and partially hydrolyzed polyacrylamides and salts thereof, carboxylated polymers derived from homopolymerization of acrylonitrile and acrylamide and salts thereof, carboxylated polymers derived from copolymerication of acrylonitrile and acrylamide with one or more ethylenically unsaturated comonomers and salts thereof, homopolymers and copolymers of hydroxyethyl methacrylate and hydroxypropylmethacrylate and salts thereof, and carboxylated or partially carboxylated polymers derived from copolymerization of maleic anydride with one or more ethylenically unsaturated comonomers, and esters, partial esters and salts thereof.

6. The method of claim 5 where said polysaccharide is selected from the group consisting of carboxyalkyl cellulose, carboxyalkyl guar, carboxyalkylhydroxyalkyl guar, carboxyalkylhydroxyalkyl cellulose wherein said alkyl groups are methyl, ethyl or propyl radicals; karaya gum, xanthan gum, tragacanth gum, gum ghatti, carrageenin, psyllium, gum acacia, oxidized starches, oxidized cellulose, arabinogalactan, hemicelluloses, and ammonium or alkali metal salts thereof.

7. The method of claim 1 where said polyvalent cation is selected from zirconium and aluminum salts, complexes and partially alkylated compounds.

8. The method of claim 7 where said pigment to binder ratio ranges from about 9:1 to about 4:1 for blade coating operations and from 9:1 to a coating formulation where only binder is present for size press operation.

9. The method of claim 8 where said polymer is present in an amount ranging from about 1 part to 20 parts based on 100 parts pigment for a blade coating operation and from about 1 part based on 100 parts pigment to a coating entirely of polymer in a size press operation.

10. The method of claim 1 where there is further present an epoxides, imines, epihalohydrins, polyhaloalkanols, amine-epihalohydrin adducts and other carboxylate reactive cross-linkers.

11. The method of claim 1 where said pigment to binder ratio ranges from about 9:1 to a coating where only binder is present.

12. The method of claim 1 where said said polymer is present in an amount ranging from about 1 part based on 100 parts pigment to comprising the entire coating.

* * * * *